US009943879B2

(12) United States Patent
Doyle et al.

(10) Patent No.: US 9,943,879 B2
(45) Date of Patent: Apr. 17, 2018

(54) METHOD OF SHAPING A SURFACE COATING ON A RAZOR BLADE

(71) Applicant: Edgewell Personal Care Brands, LLC., Chesterfield, MO (US)

(72) Inventors: Timothy Doyle, Portland, CT (US); Tomasz Hejmowski, Milford, CT (US); Massimo Nyiry, Milford, CT (US); David Tressel, Bethany, CT (US); Yiming Xu, Milford, CT (US)

(73) Assignee: Edgewell Personal Care Brands, LLC, Chesterfield, MO (US)

( * ) Notice: Subject to any disclaimer, the term of this patent is extended or adjusted under 35 U.S.C. 154(b) by 261 days.

(21) Appl. No.: 14/875,955

(22) Filed: Oct. 6, 2015

(65) Prior Publication Data

US 2016/0096282 A1 Apr. 7, 2016

Related U.S. Application Data

(60) Provisional application No. 62/060,174, filed on Oct. 6, 2014.

(51) Int. Cl.

| | |
|---|---|
| ***B05D 3/04*** | (2006.01) |
| ***B05D 3/10*** | (2006.01) |
| ***B26B 21/60*** | (2006.01) |
| ***B05D 3/00*** | (2006.01) |
| ***B05D 3/12*** | (2006.01) |

(Continued)

(52) U.S. Cl.

CPC ..... *B05D 3/107* (2013.01); *B05D 3/007* (2013.01); *B05D 3/042* (2013.01); *B05D 3/0466* (2013.01); *B05D 3/12* (2013.01); *B05D 5/083* (2013.01); *B05D 7/14* (2013.01); *B26B 21/60* (2013.01); *B05D 2202/00* (2013.01); *B05D 2506/10* (2013.01); *B05D 2506/15* (2013.01)

(58) Field of Classification Search

CPC ..... B05D 3/007; B05D 3/0466; B05D 3/107; B05D 3/12; B05D 5/083; B05D 7/14; B05D 2202/00; B05D 2506/10; B05D 2506/15

USPC ..... 427/348

See application file for complete search history.

(56) References Cited

U.S. PATENT DOCUMENTS

| | | | |
|---|---|---|---|
| 3,743,551 | A | 7/1973 | Sanderson et al. |
| 3,838,512 | A | 10/1974 | Sanderson |
| 5,488,774 | A | 2/1996 | Janowski |

(Continued)

FOREIGN PATENT DOCUMENTS

| | | |
|---|---|---|
| JP | 5922684 | 2/1984 |
| JP | S592264 A | 2/1984 |
| WO | WO8704471 | 7/1987 |

OTHER PUBLICATIONS

International Serach Report of PCT/US15/54173, filed Oct. 6, 2015.

*Primary Examiner* — William P Fletcher, III

(74) *Attorney, Agent, or Firm* — Edgewell Personal Care, Brands, LLC

(57) ABSTRACT

A method for shaping a coating on a razor blade, and a razor blade produced using the aforesaid method, are provided. The method includes the steps of a) providing a razor blade having a tip end defined by at least one tip surface and a cutting edge; b) applying a surface coating having a first thickness on at least one tip surface; and c) shaping the surface coating on the at least one tip surface to have a second thickness using a fluid stream, which second thickness is less than the first thickness.

27 Claims, 5 Drawing Sheets

(51) Int. Cl.
*B05D 7/14* (2006.01)
*B05D 5/08* (2006.01)

(56) References Cited

U.S. PATENT DOCUMENTS

| | | | | |
|---|---|---|---|---|
| 5,985,459 | A | 11/1999 | Kwiecien et al. | |
| 7,247,249 | B2 | 7/2007 | Trankiem | |
| 2005/0155460 | A1 * | 7/2005 | Trankiem ..... | B05D 3/107 76/104.1 |

* cited by examiner

METHOD OF SHAPING A SURFACE COATING ON A RAZOR BLADE

CROSS REFERENCE TO RELATED APPLICATIONS

This application claims the benefit of U.S. Provisional Patent Application Ser. No. 62/060,174, filed Oct. 6, 2014, the contents of which are incorporated herein in their entirety for reference.

BACKGROUND

1. Technical Field

The present disclosure relates to razor blades in general, and to razor blades with surface coatings in particular.

2. Background Information

Razor blades are typically made of a suitable substrate material such as stainless steel, and a cutting edge is formed with a wedge-shaped configuration with an ultimate tip having a radius less than about 100 nm, such as about 20 to 30 nm. Hard coatings such as diamond, amorphous diamond, diamond-like carbon (DLC) material, nitrides, carbides, oxides or ceramics are often used to improve strength, corrosion resistance and shaving ability, maintaining needed strength while permitting thinner edges with lower cutting forces to be used.

It is known from the art, for instance from U.S. Pat. Nos. 3,743,551 and 3,838,512, that the shaving properties of a razor blade can be improved by applying a polymer outer surface coating (e.g., polytetrafluoroethylene—"PTFE"). Typically, polymer coatings of this type are applied to create a relatively thin layer (e.g., equal to or less than 500 nm) on at least the tip of the blade. The layer can be applied using a variety of different techniques; e.g., spray application, bath dipping, etc. Since no application process will apply a perfectly uniform layer thickness across the entire desired surface, the thickness of the initially applied layer is typically chosen to ensure adequate layer thickness given an expected thickness variation. Although this "relatively" thin layer ensures adequate layer thickness, it is not optimum for shaving; e.g., it is too thick. During the first few strokes of use of a new coated blade, a portion of the polymer coating (if left at the initial thickness) will be removed from the tip during the shaving process by the user of the blade. This process of moving the surface coating by the user of the blade via contact is sometimes referred to as "push back" or "peel back" of the coating. After the excess polymer coating is "pushed back" by the user, a much thinner layer of polymer coating (a layer that can be one polymer molecule thick) typically remains on the blade edge throughout the useful life of the blade. Until the initial thickness of the polymer coating is "pushed back," however, the user can experience some amount of discomfort.

U.S. Pat. Nos. 5,985,459 and 7,247,249 disclose treating a razor blade cutting edge having an adherent polyfluorocarbon coating with a solvent to partially remove some of the coating, apparently to potentially avoid the aforesaid discomfort associated with the excessively thick coating. Using a solvent can significantly add to the manufacturing cost, and in some instances add additional manufacturing steps. For example, the '459 Patent discloses that in some instances a post-solvent treatment step can be used to remove any excess solvent.

SUMMARY

According to an aspect of the present disclosure, a method for shaping a coating on a razor blade is provided. The method includes the steps of: a) providing a razor blade having a tip end defined by at least one tip surface and a cutting edge; b) applying a surface coating having a first thickness on at least one tip surface; and c) shaping the surface coating on the at least one tip surface to have a second thickness using a fluid stream, which second thickness is less than the first thickness.

In an embodiment of the foregoing aspect the method further includes the step of sintering the applied surface coating, including heating the applied surface coating to a temperature at which the applied surface coating is in a plastic state.

In a further embodiment of any embodiment or aspect provided above, the step of shaping the applied surface coating includes directing the fluid stream at the applied surface coating in a manner that causes a portion of the applied surface coating to move away from the tip end of the razor blade and leave a residual surface coating layer having a second thickness.

In a further embodiment of any embodiment or aspect provided above, the fluid stream is directed at the applied surface coating in a manner that causes a portion of the applied surface coating to move aftward away from the tip end of the razor blade.

In a further embodiment of any embodiment or aspect provided above, the residual surface coating layer extends aftward from the cutting edge over substantially all the tip surface.

In a further embodiment of any embodiment or aspect provided above, the step of shaping the surface coating on the at least one tip surface further includes shaping the surface coating to have a plurality of thicknesses.

According to another aspect of the present invention, a method for shaping a coating on a razor blade is provided. The method includes the steps of: a) providing a stack of razor blades, each razor blade having a tip end defined by at least one tip surface and a cutting edge, wherein all the razor blades within the stack are arranged with the tip ends disposed on one side of the stack, and wherein each razor blade has an applied surface coating having a first thickness applied on the at least one tip surface; b) disposing the stack of razor blades within a fixture; and c) shaping the applied surface coating on the at least one tip surface of each razor blade to have a second thickness using a fluid stream, which second thickness is less than the first thickness.

In an embodiment of the foregoing aspect, the method includes the step of sintering the applied surface coating on each of the razor blades within the stack, including heating the applied surface coating on each razor blade to a temperature at which the applied surface coating is in a plastic state.

In an embodiment of any embodiment and aspect provided above, the fluid stream exits a fluid stream nozzle disposed in a furnace and during the step of shaping the applied surface coating on the at least one tip surface of each razor blade the fixture holding the stack of razor blades is disposed within the furnace. The method further includes the steps of: a) providing a non-reactive gas environment within the furnace; and b) heating the applied surface coating on each razor blade within the furnace to a temperature at which the applied surface coating is in a plastic state.

In an embodiment of any embodiment and aspect provided above, the step of shaping the applied surface coating on the at least one tip surface of each razor blade includes selectively moving one or both of the fixture and the fluid steam nozzle relative to the other.

In a further embodiment of any embodiment or aspect provided above, the fluid stream comprises a gas, which gas can be non-reactive with one or both of a surface coating material or a razor blade material, and which gas can include at least one of Nitrogen or Argon.

In a further embodiment of any embodiment or aspect provided above, the surface coating comprises a fluoropolymer, for example polytetrafluoroethylene.

In a further embodiment of any embodiment or aspect provided above, the fluid stream comprises a gas and solid particles, which solid particles can comprise $CO_2$.

In a further embodiment of any embodiment or aspect provided above, the fluid stream comprises a liquid, which liquid can include $H_2O$.

According to an aspect of the present invention, a razor blade is provided. The razor blade includes a tip end defined by at least one tip surface and a cutting edge, and a coating. The coating on the at least one tip surface is shaped by any embodiment or aspect of the present methods described above.

These and other objects, features and advantages of the present invention will become apparent in light of the detailed description of the invention provided below, and as illustrated in the accompanying drawings.

DETAILED DESCRIPTION

The present disclosure includes methods, and embodiments thereof, for manufacturing a razor blade with a surface coating, and more specifically to methods for shaping a surface coating disposed on a surface of a razor blade.

Figure 1:
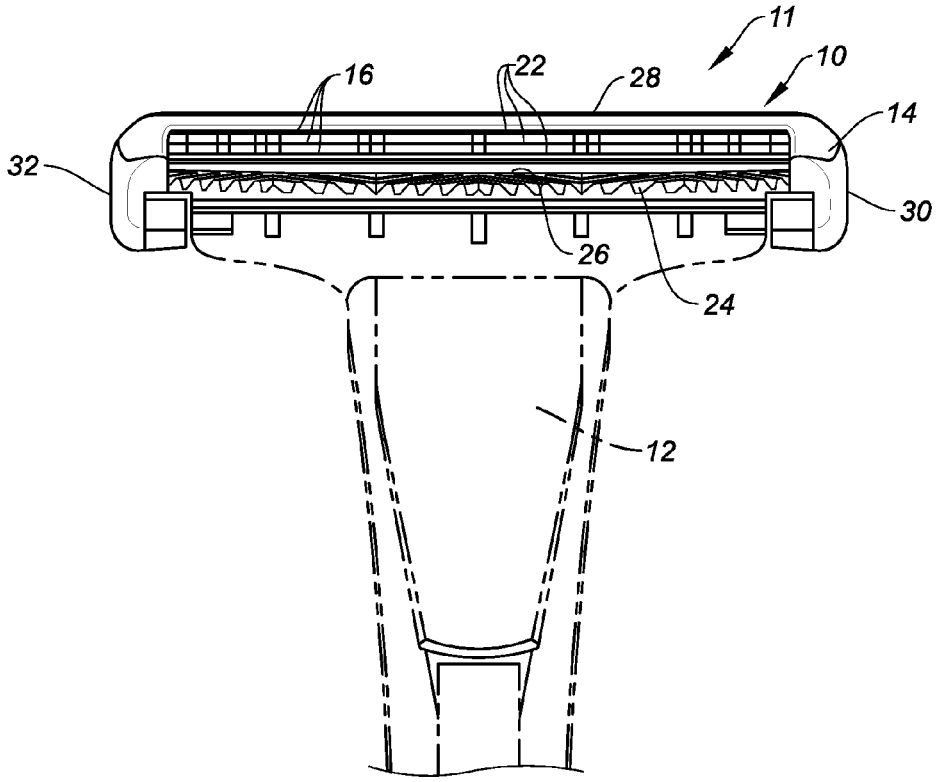
FIG. 1 is a planar front view of a razor assembly including a razor cartridge and a handle.
Figure 2:
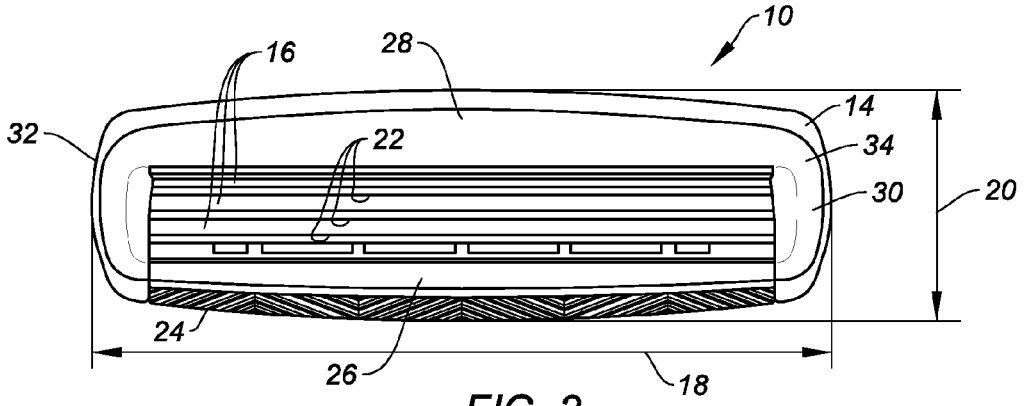
FIG. 2 is a planar top view of the razor cartridge shown in FIG. 1.
Figure 3:
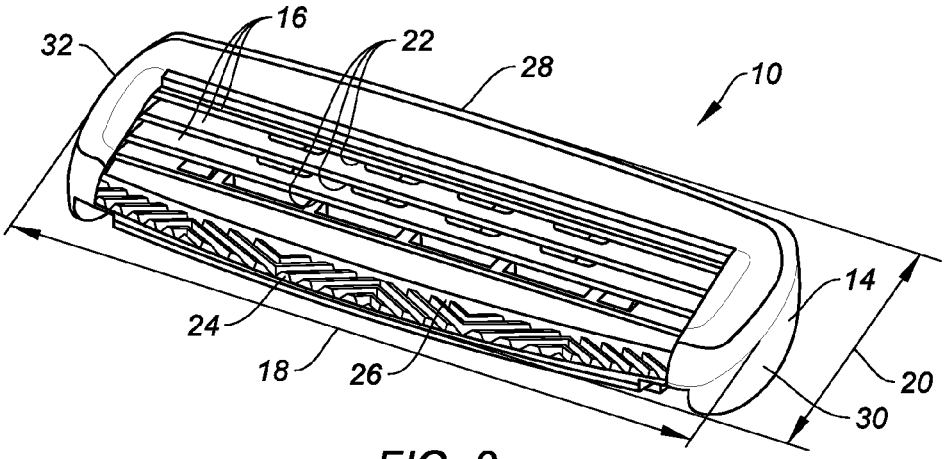
FIG. 3 is a perspective view of a razor cartridge.

Referring to FIGS. 1-3, an exemplary razor cartridge 10 is shown to facilitate the description provided herein. The present disclosure is not limited to this particular razor cartridge embodiment. The razor cartridge 10 pivotally or rigidly mounts on a handle 12 (shown in phantom in FIG. 1). In some applications, the razor cartridge 10 is a disposable portion of a razor assembly 11 intended to be detachable from a reusable handle 12. In other applications, the razor cartridge 10 and a handle 12 are combined into a unitary disposable razor assembly 11. In the latter form, the handle 12 and cartridge 10 are not intended to be detached from one another during normal use.

The razor cartridge 10 includes a body 14, one or more razor blades 16, a length 18, and a width 20. Each of the one or more razor blades 16 has a lengthwise extending cutting edge 22. The present disclosure is not limited to any specific cutting edge configuration, however; e.g., the present disclosure is applicable to linear cutting edges, non-linear cutting edges, cutting edges extending around the perimeter of apertures, etc. The razor cartridge 10 preferably also includes a guard 24. For sake of clarity, the terms "forward" and "aft" as used herein are defined in terms of the orientation in which a blade encounters a user's skin when the blade is used conventionally; e.g., when a razor blade 16 is used in a conventional manner, the blade will move in a direction from forward to aft relative to a point on the user's skin—a forward blade element will encounter the point before an aft blade element. The body 14 includes a forward portion 26, an aft portion 28, a first lateral portion 30, and a second lateral portion 32. The forward portion 26 is disposed between the guard 24 and the one or more razor blades 16. The aft portion 28 (sometimes referred to as the "cap") is disposed aft of the one or more razor blades 16. The first lateral portion 30 and second lateral portion 32 are disposed on opposite lateral sides of the one or more razor blades 16, and both extend between the forward portion 26 and the aft portion 28.

A razor blade 16 according to the present disclosure can assume a variety of configurations, each including a body 34 having a width 36 extending between a tip end 38 and an aft end 40, and a length 42 extending between a first lateral edge 44 and a second lateral edge 46. The body 34 further includes an upper body surface 48 and a lower body surface 50, which body surfaces 48, 50 extend widthwise between the tip end 38 and the aft end 40, and lengthwise between the first and second lateral edges 44, 46. The razor blade description provided herein and shown in the Figures is included to facilitate understanding of the present disclosure. The present disclosure is not limited to this particular razor blade embodiment.

Figure 4:
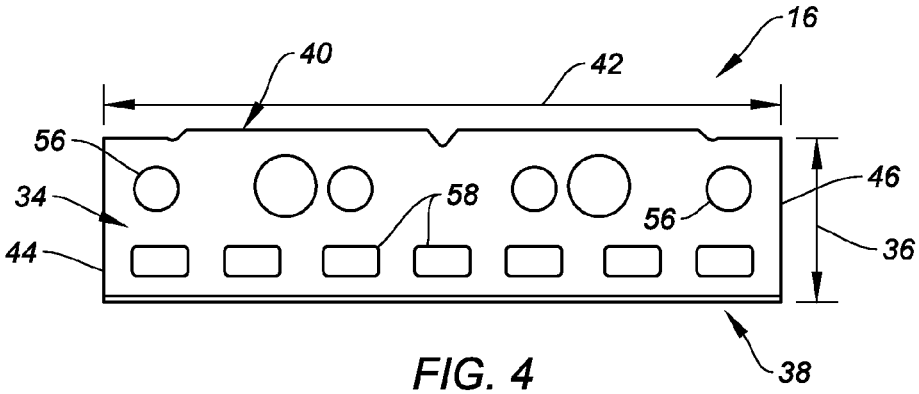
FIG. 4 is a planar top view of an exemplary razor blade that can be used with the present methods.
Figure 5:
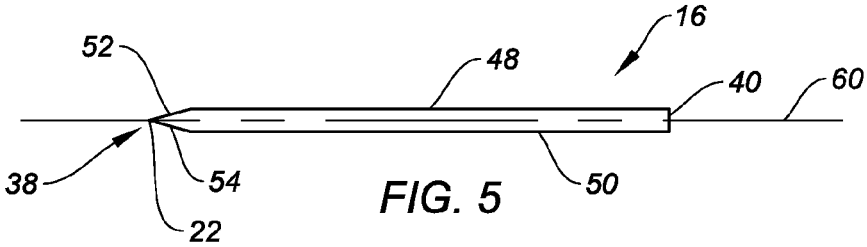
FIG. 5 is a planar side view of an exemplary razor blade that can be used with the present methods.

Referring to FIGS. 4 and 5, the tip end 38 is typically defined by a first tip surface 52, a second tip surface 54, and a cutting edge 22. The first and second tip surfaces 52, 54 converge at the cutting edge 22, each extending aftward to the respective body surface 48, 50 of the razor blade 16. Strictly speaking, in many instances there can be a small radiused surface (sometimes referred to as a "tip radius") at the convergence of the first and second tip surfaces 52, 54. The tip end 38 can also be alternatively configured to have a single tip surface extending between the cutting edge 22 and a body surface of the razor blade 16. The present disclosure is not limited to any particular blade tip configuration. The razor blade 16 shown in FIG. 4 includes a plurality of apertures that extend through the blade, between the body surfaces of the blade. Some of the apertures 56 can be used to locate/secure the blades 16 within the razor cartridge, and other apertures 58 are wash-through ports that facilitate removal of shaving debris. The razor blade 16 can also be described as having a widthwise extending centerline 60 that is typically parallel to the body surfaces 48, 50 in at least the region proximate the tip end 38. Razor blades 16 are often, but not always, manufactured from a stainless steel material, and can as indicated above include a coating comprising one or more materials such as diamonds, amorphous diamonds, diamond-like carbon (DLC) materials, nitrides, carbides, oxides, ceramics, or the like, to improve strength, corrosion resistance and shaving ability. The present method for manufacturing a razor blade 16 with a surface coating, including a method for forming a surface coating adhered to a surface of the razor blade 16, is not limited to practice on any particular razor blade configuration, nor any particular razor blade tip configuration or cutting edge geometry, or blade material.

Referring to FIGS. 6-9, according to aspects of the present invention a surface coating applied to a tip end 38 of a razor blade 16 is shaped using a stream of fluid directed at the surface coating. As will be explained below, the present shaping process alters the thickness of surface coating from an initially applied thickness to a residual applied thickness.

Figure 6:
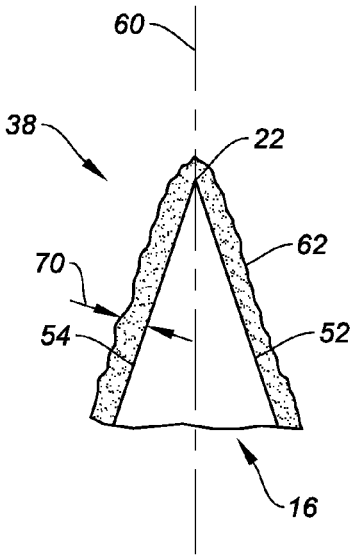
FIG. 6 is a diagrammatic illustration of a razor blade tip end with an initial surface coating applied.
Figure 7:
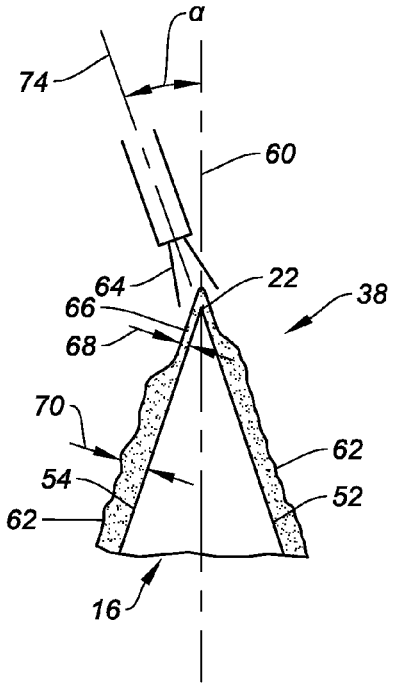
FIG. 7 is a diagrammatic illustration of a razor blade tip end with a surface coating applied, with a fluid stream engaging the surface coating.
Figure 8:
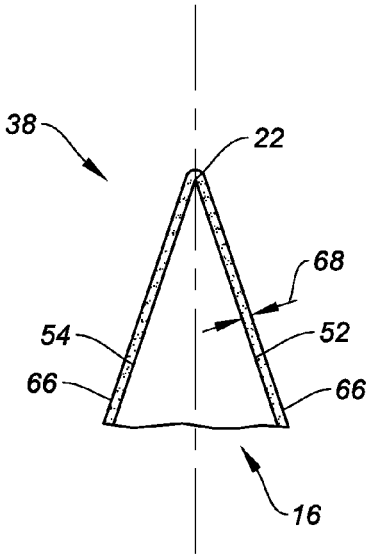
FIG. 8 is a diagrammatic illustration of a razor blade tip end with a surface coating applied, illustrating an embodiment of a residual surface coating layer portion.
Figure 9:
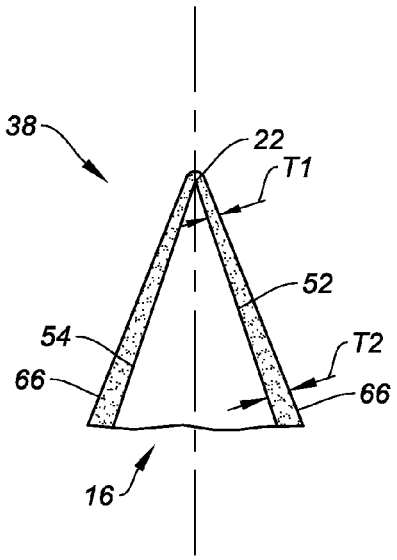
FIG. 9 is a diagrammatic illustration of a razor blade tip end with a surface coating applied, illustrating an embodiment of a residual surface coating layer portion.

The surface coating is initially applied to a tip end 38 of a razor blade 16, which initial coating can be referred to hereinafter as an "initial surface coating 62" (see FIG. 6). Typically, the initial surface coating 62 is disposed only on the exterior surface of the tip end 38, but can also be applied to additional surfaces of the razor blade 16. Hereinafter, where the surface coating is described as being deposited on the tip end 38, such description should be construed as being applied to at least a surface of the tip end 38 and can also be deposited on additional surfaces of the razor blade 16.

The surface coating according to the present disclosure can comprise a variety of different materials. Useful surface coating materials include, but are not limited to, fluoropolymers. A particularly useful fluoropolymeric surface coating material is polytetrafluoroethylene ("PTFE"). Specific examples of fluoropolymers include ZONYL® MP1100, MP1200, MP1600, and KRYTOX® LW1200 brand polytetrafluoroethylene powders manufactured by E.I. DuPont de Nemours and Company, U.S.A, now Chemours Company. Other non-limiting examples of surface coating materials include silicon, organosiloxane gel, etc. The present method is not limited to using any particular type of surface coating material provided the material can be processed in the manner described below. To facilitate the description of the present method, the surface coating material will be discussed as being PTFE. As indicated above, however, the present method is not limited to use with PTFE type surface coating materials.

The present method does not require, and is therefore not limited to, any particular type of process for applying the initial surface coating 62. Examples of application processes that can be used include chemical vapor deposition, laser deposition, sputtering deposition, and nebulization processes. A particularly useful application process is one in which surface coating materials (e.g., PTFE particles) are initially disposed in a dispersion. The dispersion can then be deposited on the tip end 38 in any suitable manner, as for example, by brushing, dipping, or spraying the dispersion onto the tip end 38 to form the initial surface coating 62. The surface coating materials are deposited on the tip end 38 until a layer of the aforesaid materials is formed with a thickness that ensures adequate coverage of the appropriate surface.

According further to the present disclosure, the blade 16 or blades 16 with the deposited surface coating materials are subjected to a thermal sintering process that includes heating the blade and deposited surface coating materials to a predetermined temperature for a period of time adequate for the PTFE particles to fuse together and to adhere to the razor blade 16 and in some instances to drive off the dispersing media, thereby forming a sintered form of the aforesaid initial surface coating 62. During the sintering process, the thickness of the surface coating can decrease from that of the initial surface coating 62.

While the sintered surface coating is in a plastic state, the blade tip end 38 is subjected to a fluid stream 64 at fluid and flow parameters (e.g., velocity, pressure, volumetric flow rate, temperature, etc.) adequate for that particular fluid stream to impact the initial surface coating 62 at the tip end 38 and move (or remove) a portion of the initial surface coating 62 away from the tip end 38, leaving a layer of surface coating material (which can be referred to herein as a "residual surface coating layer 66") having a thickness 68 less than the thickness 70 of the initial surface coating 62. The term "thickness" as used herein to describe a dimension of the surface coating layer should not be construed as meaning that the surface coating layer thickness is exactly uniform in the razor blade region described as having that surface coating layer. Rather, the term "thickness" refers to an average thickness in the aforesaid region; e.g., a region described as having a residual surface coating layer 66 of "X" thickness, will have an average thickness of "X" within the region, but can have slight variations in thickness at particular points within the region. The present disclosure is not limited to any particular fluid stream parameters; e.g., the fluid and flow parameters can be chosen as a function of the type fluid used and the surface coating material.

The term "plastic state" as used herein is used to describe the surface coating material being in a form that is capable of being shaped by a fluid stream as will be described below and retaining that shape subsequent to the shaping process. A polymeric surface coating material will typically be in a "plastic state" at a temperature near or above its melting point. As an example, a polymer such as PTFE has a substantially greater stiffness at an ambient temperature than it possesses at an elevated temperature near or above its melting point.

The fluid stream 64 directed at the blade tip end 38 can be configured in a single defined stream that impacts substantially all of the lengthwise extending blade tip end 38, or a plurality of streams 64 oriented to collectively impact substantially all of the lengthwise extending blade tip end 38, or a stream 64 having a geometry (e.g., diameter) that is smaller than the length of the blade 16 and is moved relative to the blade 16 (or vice versa), or any combination thereof. The fluid stream 64 can be constantly or intermittently applied; e.g., pulsed. The fluid stream 64 is typically produced from one or more nozzles 72 having a nozzle exit orifice positioned a predetermined distance from blade tip end 38 being processed. The geometry of the fluid stream 64 exiting the nozzle orifice is a function of the fluid and flow parameters, and also of the geometry of the nozzle orifice. The nozzle orifice geometry is chosen in concert with the fluid and flow parameters so as to be adequate for the chosen fluid stream 64 to impact the initial surface coating 62 at the tip end 38 and move (or remove) a portion of the initial surface coating 62 away from the tip end 38, leaving the aforesaid residual surface coating layer 66.

The orientation of the fluid stream 64 relative to the blade tip end 38 (e.g., the angle "a" between a centerline 74 of the fluid stream 64 and the widthwise extending centerline 60 of the blade 16) is chosen based in part on the geometry of the blade tip end 38 (e.g., two tip surfaces vs. one tip surface, etc.), and is chosen so as to be adequate for the chosen fluid stream 64 to impact the initial surface coating 62 at the tip end 38 and move (or remove) a portion of the initial surface coating 62 away from the tip end 38, leaving the aforesaid residual surface coating layer 66.

The fluid used to form the fluid stream 64 can include one or more materials. Preferably, the materials are non-reactive (e.g., chemically non-reactive) with surface coating material and with the razor blade material. A "non-reactive" fluid, as that term is used herein, means that the fluid when engaged with the surface coating does not cause a change in a material property of the surface coating material (e.g., chemically alter the surface coating material) in a manner that would detrimentally affect the ability of the surface coating material to perform as a surface coating. Similarly, in terms of a razor blade 16, a "non-reactive" fluid, as that term is used herein, means that the fluid when engaged with the razor blade 16 does not cause a change in a material property of the razor blade material (e.g., chemically alter the razor blade material) in a manner that would detrimentally affect the performance or appearance (e.g., surface discoloration) of the razor blade 16. In some embodiments, the fluid stream 64 can be a gaseous stream. The present disclosure is not limited to any particular type of gas, and acceptable gases can depend on the type of materials present within the surface coating and razor blade 16. Nitrogen ($N_2$) and Argon (Ar) are examples of acceptable gaseous fluids for use with a PTFE type surface coating applied to a stainless steel razor blade 16. In some embodiments, the fluid stream 64 can include solid particles. For example, a gaseous fluid flow can include frozen carbon dioxide ($CO_2$) particles. Particles comprising a material such as frozen $CO_2$ are favorable due to the small particle size, and particle hardness relative to the hardness of the razor blade 16; e.g., particles of a size and hardness operable to remove a portion of the surface coating material, that will not damage the razor blade (e.g., the substrate). In some embodiments, the fluid stream 64 can be a liquid (e.g., water—$H_2O$).

Depending upon the properties of the surface coating material, the fluid stream 64 can be applied to the blade 16 during the sintering process, or subsequent to the sintering process but while the surface coating material is still in a plastic state, or in a step subsequent to the sintering process.

As an example of a process wherein the fluid stream 64 is applied to the blade 16 at a point during the sintering process, a surface coating comprised primarily of PTFE is applied to a razor blade tip end 38 to form an initial surface coating 62. The blade 16 with the applied initial surface coating 62 can be subjected to a first heating period in which the blade 16 is maintained at an elevated temperature for a period of time to initiate the sintering process. The sintering process is preferably performed in an environmentally controlled furnace (e.g., see FIG. 12) that enables the razor blade 16 to be disposed in a controlled gas environment at the elevated temperature. Typically, the environmental gas (es) used in the sintering process is one that is non-reactive with the surface coating material, and one that minimizes or prevents degradation (e.g., oxidation) of the razor blade 16. Nitrogen gas ($N_2$) and argon gas (Ar) are non-limiting examples of acceptable environmental gases. In some applications, the environmental gas(es) can include one or more gases that react with oxygen present in the furnace to decrease the potential for oxidation of elements within the furnace. By the end of the first heating period, the initial surface coating 62 is typically at least partially melted and therefore in a plastic state.

Figure 10:
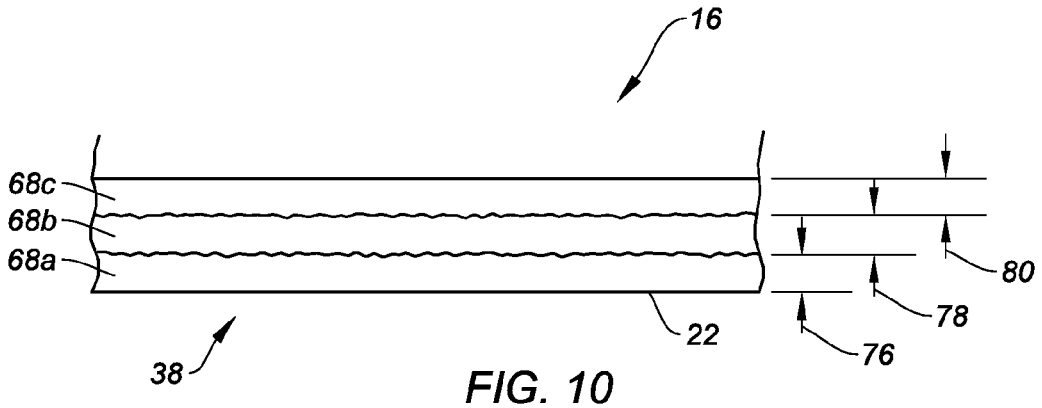
FIG. 10 is a diagrammatic illustration (planar top view) of a razor blade tip end with a surface coating applied, illustrating an embodiment of a residual surface coating layer portion.

At this point, a fluid stream 64 (at given parameters and nozzle configuration) is directed at the blade tip end 38 in a manner that causes the fluid stream 64 to impact the initial surface coating 62 at the tip end 38 and move (or remove) a portion of the initial surface coating 62 away from the tip end 38, leaving a layer of surface coating material (i.e., a residual surface coating layer 66) having a thickness 68 less than the thickness 70 of the initial surface coating 62. The period of time in which the fluid stream 64 is used to shape the initial surface coating 62 to leave a residual surface coating layer 66 can be referred to as the "formation period". During the formation period, the razor blade 16 and applied surface coating can be maintained at the same temperature, or a different temperature, as used in the first heating period. A fluid stream 64 having a centerline 74 oriented to be approximately perpendicular to the cutting edge 22 will cause surface coating material to be moved aft, away from the cutting edge 22 of the blade 16. In some applications, the fluid stream 64 can cause some or all of the surface coating "moved" to be removed from the razor blade 16. The fluid stream 64 is applied until only a residual surface coating layer 66, which can have a thickness 68 equivalent to about a monolayer of surface coating material particles, is moved back an adequate distance aft of the cutting edge 22. The residual surface coating layer 66 can have a uniform thickness 68 over the entire tip end surface(s) (e.g., see FIG. 8), but such a uniform thickness residual surface coating layer 66 is not required. Indeed, in some applications, the residual surface coating layer 66 can include a plurality of different thickness regions (e.g., 68*a*, 68*b*, 68*c*, where 68*a*<68*b*<68*c*; see FIG. 10); e.g., a substantially uniform first thickness first region 68*a* that extends aft from the cutting edge 22 a first distance 76, and then transitions into a substantially uniform second thickness region 68*b* that extends aft from the first region a second distance 78, and then transitions into a substantially uniform third thickness region 68*c* that extends aft from the second region a third distance 80, etc. Alternatively, the residual surface coating layer 66 can increase in thickness extending aft from the cutting edge according to a predetermined profile (e.g., T1<T2; see FIG. 9); e.g., a linear thickness increase, etc.

The description above provides an example of a process wherein the fluid stream 64 is applied to the razor blade 16 at a point during the sintering process. Once the surface coating at the tip end 38 is shaped to a residual surface coating layer 66, the sintering process is continued at a predetermined temperature for an additional period of time (e.g., a second heating period that can be at the same temperature or a different temperature than used in the first heating period or as used in the formation period) without the fluid stream 64 until the sintering process is completed.

In regards to a process wherein the surface coating at the tip end 38 is shaped to a residual surface coating layer 66 subsequent to the sintering process but while the surface coating material is still in a plastic state, essentially the same process as described above can be followed; e.g. the application of the fluid stream 64 to move a portion of the initial surface coating 62 away from the tip end 38 to leave the residual surface coating layer 66. In regards to a process wherein the surface coating at the tip end 38 is shaped to a residual surface coating layer 66 subsequent to the sintering process, the razor blade 16 with the initial surface coating 62 (now in sintered form) can be heated until the surface coating material is in a plastic state. Upon reaching the plastic state, a fluid stream formation process as described above can be used. Alternatively, the razor blade 16 with the sintered initial surface coating 62 can be processed with the aforesaid blades 16 and sintered coating 62 at an ambient temperature and the relatively high temperature fluid stream 64 can be used to heat the surface coating material to a plastic state for subsequent shaping.

In regards to the specific physical characteristics of the residual surface coating layer 66, the specific thickness of the residual surface coating layer 66 and the distance that the residual surface coating layer 66 (and regions thereof as applicable) extends aft of the cutting edge 22 can be chosen to suit the application at hand; e.g., to create a desired comfort level for the user of the particular razor blade 16 and surface coating. It is our understanding that during the normal useful life of the razor blade 16, the residual layer of surface coating material will remain adhered to the tip end surfaces.

Figure 11:
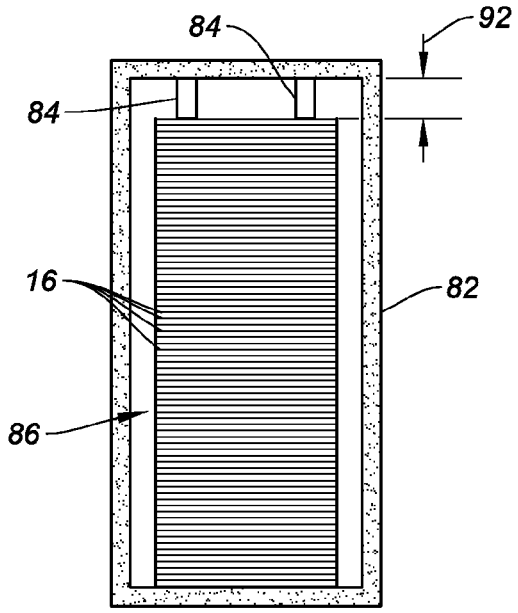
FIG. 11 is a diagrammatic illustration of a stack of razor blades disposed within a fixture embodiment.
Figure 12:
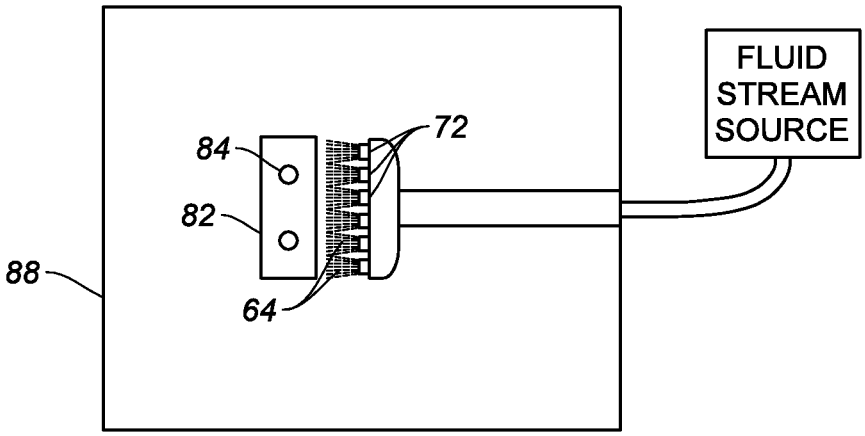
FIG. 12 is a diagrammatic illustration of a fixture holding a stack of blades disposed within an furnace with a plurality of nozzles producing fluid streams acting on at least one razor blade disposed within the stack.
Figure 13:
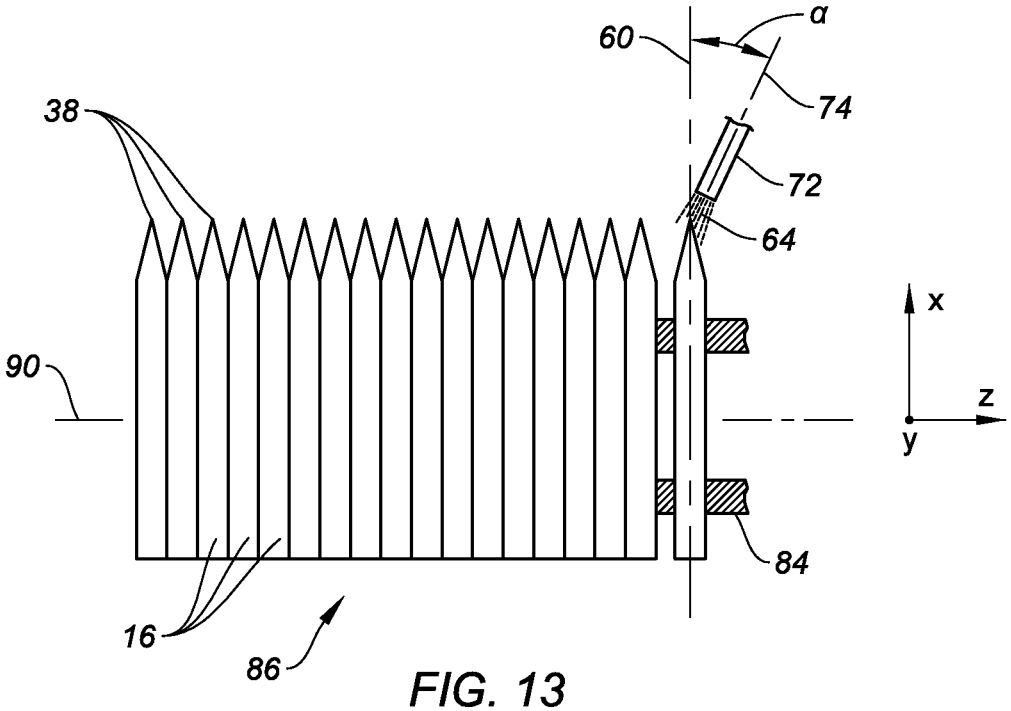
FIG. 13 is a diagrammatic illustration of a fixture holding a stack of blades disposed within an furnace with a nozzle producing a fluid stream acting on a razor blade disposed within the stack.

Referring to FIGS. 11-13, according to an aspect of the present disclosure a method for producing a residual layer of surface coating on a razor blade 16 includes mounting a plurality of razor blades 16 (i.e., a "stack 86" of blades) within a fixture 82 that allows the blades 16 to be stacked in the same orientation, with the blade tip ends 38 exposed. In one embodiment, the fixture 82 includes one or more blade retaining members; e.g., at least two rods 84 that extend through apertures (e.g., through location/mounting apertures 56, or through wash-out ports 58) within the blades 16. The fixture 82 can provide spacers (not shown) disposed between each razor blade 16, or alternatively can provide clearance space 92 (e.g., the fixture 82 and rods 84 are longer than the stack 86 of blades) so that the blades 16 can move relative to one another during the surface coating formation process. In this method, the fluid stream 64 is directed at the blade tip ends 38 disposed in the fixture 82 in a manner that causes the fluid stream 64 to impact the initial surface coating 62 at the tip end 38 and move a portion of the initial surface coating 62 away from the tip end 38, leaving the above-described residual surface coating layer 66. The fixture 82 can be moved relative to the fluid stream(s) 64 or vice versa to permit the formation of the above-described residual surface coating layer 66. In those instances where a fixture 82 is used that provides an optional clearance space 92, our experience is that the relative movement of the fixture 82 and the fluid stream(s) 64 causes the individual razor blades 16 within the stack 86 to move relative to one another. The movement of each individual razor blade 16 within the stack 86 enables the fluid stream 64 to access the respective individual cutting edges 22 within the stack 86 and accomplish the above-described formation of the residual surface coating layer 66 without the need for inter-blade spacers. The above-described fixtures 82 are non-limiting examples of fixtures that can be used to process a plurality of blades 16 in a single process as opposed to a single blade surface coating process.

The fixture 82 is selectively mountable relative to a device operable to heat the razor blades 16 within the fixture 82 to a temperature where the surface coating material is in a plastic state. For example, the fixture 82 holding the stack 86 of blades 16 can be selectively mounted within a furnace 88 operable to heat the stack 86 of razor blades 16 with surface coating material within a controlled environment of a non-reactive gas. The furnace 88 is modified to include one or more fluid stream nozzles 72 and to mount the fixture 82 (and therefore the razor blades 16) in a predefined orientation relative to the nozzles 72. The above-described method for shaping the surface coating on the razor blades 16 can be subsequently performed within the furnace 88.

To ensure a fully enabled description of the present disclosure, a specific example of a formation process is provided hereinafter. The present disclosure is not limited to the following example.

In this example, a plurality of razor blades 16 is processed to create a residual surface coating layer 66 on surfaces of the tip end 38 of each blade. First, an initial surface coating 62 layer of PTFE (e.g., KRYTOX® LW-1200 by Chemours Company) is applied to the tip end surfaces 52, 54 of the plurality of blades 16 by spraying the tip end surfaces 52, 54 with a dispersion that includes PTFE particles disposed within a dispersing media. The initial surface coating layer 62 is applied to a thickness of no more than 500 nm, and preferably applied to a thickness of between 100 nm and 400 nm, and allowed to dry, i.e. the dispersing media is allowed to evaporate.

The "initial coating applied" blades 16 are subsequently stacked and retained within a fixture 82 having a pair of rods 84 that extend through apertures within the blades 16, and which fixture 82 can include clearance space 92 along the stacking axis 90 to permit relative movement between the individual blades along the stacking axis 90 during the surface coating formation process. The fixture 82 containing the stack 86 of blades 16 is subsequently placed within a furnace 88 operable to provide a controlled environment comprised substantially of nitrogen gas ($N_2$) at an elevated temperature. The nitrogen gas is non-reactive with the surface coating material and the razor blade material. The furnace 88 is modified to include one or more nozzles 72 and to mount the fixture 82 (and therefore the razor blades 16) in a predefined orientation relative to the nozzles 72. For example, the fixture 82 can be mounted so that razor blade stack 86 is horizontally oriented, with the razor blade tip ends 38 facing the nozzles 72. Each nozzle 72 is operable to produce a fluid stream 64 of nitrogen in a direction toward the tip ends 38. To facilitate the description, assume that the cutting edge 22 of each razor blade 16 extends along a "Y" axis (e.g., the length of each blade extends along the "Y" axis—shown in FIG. 13 extending perpendicular to the surface of the page) and the width 34 of each blade 16 extends along an "X" axis, and the stacking axis 90 of the razor blades extends along a "Z" axis. When a fixture 82 as described above is used, the nozzles 72 can be oriented to produce a fluid stream centerline 74 perpendicular to the cutting edge 22 of each razor blade 16 (e.g., perpendicular to the "Y" axis). The nozzle 72 orientation can also be such that the fluid stream centerline 74 is aligned with the X-axis, or can be disposed at an angle (e.g., "a") to the X-axis. During the residual layer formation process, the fixture 82 containing the stack 86 of blades 16 (and therefore the razor blades 16) is moved in a direction along the Z-axis (and possible other axes as well) relative to the nozzles 74, or vice versa. The clearance space 92 within the fixture 82 along the stacking axis 90 (which is parallel to the Z-axis) allows relative movement between the razor blades 16 within the stack 86 (e.g., individual blade flutter within the stack 86) thereby ensuring that each individual blade within the stack 86 is adequately exposed to the fluid stream 64 to allow for the above-described residual layer formation. In the alternative, the razor blades 16 within the stack 86 can be immovably clamped within the fixture 82 with no clearance space 92. Parameters such as the amount of force created by the fluid stream 64 acting of the surface coating, the separation distance between the nozzle exit orifice and the tip ends 38 of the blades 16, and the amount of dwell time each razor blade 16 is exposed to the fluid stream 64 are variables that are chosen based on the particular surface coating material, the razor blade tip end configuration, the environment within the furnace 88 (e.g., temperature), etc.

After the fixture 82 is mounted within the furnace 88 and the ambient furnace environment is replaced with a nitrogen gas environment, the razor blades 16 are heated to a temperature in the range of about 300° C. to 400° C. and preferably to a temperature in the range of about 360° C. to 380° C. at the tip ends 38 to melt the PTFE particles within the surface coating dispersion, remove any dispersing media, and fuse at least some of the PTFE particles to the blade tip end 38 in a substantially uniform thickness film. The razor blades 16 are maintained at this temperature for a period of time in the range of about one minute to about ten minutes (1-10 mins), and more preferably for a period of time in the range of about four minutes to eight minutes (4-8 mins).

Prior to subjecting the blade tip ends 38 to a fluid stream 64 comprised substantially of nitrogen gas ($N_2$), the nitrogen gas is preferably preheated to a temperature in the range of about 360° C. to 420° C. Preheating the fluid stream 64 is not required, but using a preheated fluid stream 64 prevents cooling of the surface coating layer by the fluid stream 64. Once the surface coating material is in a plastic state, then fluid stream 64 is initiated. As indicated above, the exact parameters of the fluid stream 64 will depend on the particular application and the present disclosure is not limited to particular values. For stainless steel material razor blades, a surface coating material consisting essentially of KRYTOX® LW-1200 at an initial surface coating 62 thickness in the range of between about 100 nm and 400 nm, at a temperature of in the range of about 360° C. to 420° C., a preheated fluid stream 64 comprised substantially of nitrogen gas at a flow velocity of about thirty meters per sec (30 m/s), a volumetric flow rate of about 6.8 cubic meters per hour (6.8 $m^3$/hr), pressure about 10 bar, measured and controlled before the nozzle, exiting a nozzle orifice area of about twenty-two square millimeters (22 $mm^2$), which nozzle is disposed about one to three millimeters (1-3 mm) from the razor blade tip end 38 being processed is adequate to shape the surface coating material by moving a portion of the surface coating material aftward (i.e., away from the cutting edge 22). The fluid stream 64 is formed by a single nozzle 72 and the fixture 82 is moved relative to the nozzles 72. The fluid stream forming process creates a PTFE residual surface coating layer 66 having a thickness in the range of about twenty to fifty nanometers (20-50 nm) at the cutting edge 22 that increases in thickness traveling in the direction (aft) away from the cutting edge 22. The shaped portion of the surface coating layer (i.e., the residual surface coating layer 66) extends aft from the cutting edge 22 a distance of about thirty micrometers (30 μm), albeit not necessarily at the same thickness. As indicated above, the above specific example is a non-limiting example provided to facilitate an enabling description of the present method, and the present method is not limited thereto.

Although this invention has been shown and described with respect to the detailed embodiments thereof, it will be understood by those skilled in the art that various changes in form and detail thereof can be made without departing from the spirit and the scope of the invention.

What is claimed is:

1. A method for shaping a coating on a razor blade, comprising the steps of:

providing a razor blade having a tip end defined by at least one tip surface and a cutting edge;

applying a surface coating having a first thickness on the at least one tip surface; and shaping the applied surface coating on the at least one tip surface to have a second thickness using a fluid stream, which second thickness is less than the first thickness; and wherein the fluid stream comprises a gas.

2. The method of claim 1, further comprising a step of sintering the applied surface coating, including heating the applied surface coating to a temperature at which the applied surface coating is in a plastic state.

3. The method of claim 2, wherein the step of shaping the applied surface coating includes directing the fluid stream at the applied surface coating in a manner that causes a portion of the applied surface coating to move away from the tip end of the razor blade and leave a residual surface coating layer having the second thickness.

4. The method of claim of claim 3, wherein the fluid stream is directed at the applied surface coating in a manner that causes a portion of the applied surface coating to move aftward away from the tip end of the razor blade.

5. The method of claim 3, wherein the residual surface coating layer extends aftward from the cutting edge over substantially all the tip surface.

6. The method of claim 3, wherein the step of shaping the surface coating on the at least one tip surface further includes shaping the surface coating to have a plurality of thicknesses.

7. The method of claim 1, wherein the gas is non-reactive with one or both of a surface coating material and a razor blade material.

8. The method of claim 7, wherein the gas comprises at least one of Nitrogen and Argon.

9. The method of claim 1, wherein the surface coating comprises a fluoropolymer.

10. The method of claim 9, wherein the surface coating comprises polytetrafluoroethylene.

11. The method of claim 1, wherein the fluid stream comprises a gas and solid particles.

12. The method of claim 11, wherein the solid particles comprise $CO_2$.

13. The method of claim 1, wherein the fluid stream comprises a liquid.

14. The method of claim 13, wherein the liquid comprises $H_2O$.

15. A method for shaping a coating on a razor blade, comprising the steps of:

providing a stack of razor blades, each razor blade having a tip end defined by at least one tip surface and a cutting edge, wherein all the razor blades within the stack are arranged with the tip ends disposed on one side of the stack, and wherein each razor blade has an applied surface coating having a first thickness applied on the at least one tip surface;

disposing the stack of razor blades within a fixture; and shaping the applied surface coating on the at least one tip surface of each razor blade to have a second thickness using a fluid stream, which second thickness is less than the first thickness; and wherein the fluid stream comprises a gas.

16. The method of claim 15, further comprising a step of sintering the applied surface coating on each of the razor blades within the stack, including heating the applied surface coating on each razor blade to a temperature at which the applied surface coating is in a plastic state.

17. The method of claim 15, wherein the step of shaping the applied surface coating includes directing the fluid stream at the applied surface coating in a manner that causes a portion of the applied surface coating to move away from the tip end of the razor blade and leave a residual surface coating layer having the second thickness.

18. The method of claim 15, wherein the step of shaping the applied surface coating on the at least one tip surface of each razor blade further includes shaping the applied surface coating to have a plurality of thicknesses.

19. The method of claim 15, wherein the fluid stream exits a fluid stream nozzle disposed in a furnace and during the step of shaping the applied surface coating on the at least one tip surface of each razor blade, the fixture holding the stack of razor blades is disposed within the furnace, the method further comprising the steps of:

providing a non-reactive gas environment within the furnace; and heating the applied surface coating on each razor blade within the furnace to a temperature at which the applied surface coating is in a plastic state.

20. The method of claim 15, wherein during the step of shaping the applied surface coating on the at least one tip surface of each razor blade includes selectively moving one or both of the fixture and the fluid steam nozzle relative to the other.

21. The method of claim 15, wherein the gas is non-reactive with one or both of a surface coating material and a razor blade material.

22. The method of claim 21, wherein the gas comprises at least one of Nitrogen and Argon.

23. The method of claim 15, wherein the surface coating comprises a fluoropolymer.

24. The method of claim 23, wherein the surface coating comprises polytetrafluoroethylene.

25. The method of claim 15, wherein the fluid stream comprises a gas and solid particles.

26. The method of claim 25, wherein the solid particles comprise $CO_2$.

27. A method for shaping a coating on a razor blade, comprising the steps of:

providing a stack of razor blades, each razor blade having a tip end defined by at least one tip surface and a cutting edge, wherein all the razor blades within the stack are arranged with the tip ends disposed on one side of the stack, and wherein each razor blade has an applied surface coating having a first thickness applied on the at least one tip surface;

disposing the stack of razor blades within a fixture; and shaping the applied surface coating on the at least one tip surface of each razor blade to have a second thickness using a fluid stream, which second thickness is less than the first thickness;

wherein the fluid stream comprises a liquid and wherein the liquid comprises $H_2O$.

* * * * *